US006562160B2

(12) United States Patent
Walsh

(10) Patent No.: US 6,562,160 B2
(45) Date of Patent: May 13, 2003

(54) AIRBAG PROPELLANT

(75) Inventor: Christine M. Walsh, Waldorf, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 193 days.

(21) Appl. No.: 09/832,157

(22) Filed: Apr. 10, 2001

(65) Prior Publication Data

US 2002/0144759 A1 Oct. 10, 2002

(51) Int. Cl.[7] ..... C06B 45/10
(52) U.S. Cl. ..... 149/19.7; 149/38
(58) Field of Search ..... 149/19.7, 19.91, 149/38

(56) References Cited

U.S. PATENT DOCUMENTS 5,602,361 A 2/1997 Hamilton et al. ..... 102/288
5,616,883 A 4/1997 Hamilton et al. ..... 102/288
5,695,216 A 12/1997 Sandstrom et al. ..... 280/737
5,868,424 A * 2/1999 Hamilton et al. ..... 280/741
6,009,810 A 1/2000 Walsh ..... 102/288
6,170,868 B1 * 1/2001 Butt et al. ..... 280/737

* cited by examiner

*Primary Examiner*—John Hardee
(74) *Attorney, Agent, or Firm*—Mark Homer

(57) ABSTRACT

The present invention is a propellant used to inflate an airbag in vehicle safety systems comprising from about 70 weight percent to about 82 weight percent Cyclotrimethylenetrinitramine (RDX), from about 10 weight percent to about 15 weight percent of a polymer binder, from about 6 weight percent to about 9 weight percent of an inert plasticizer, from about 2 weight percent to about 4 weight percent of Hydroxypropyl Cellulose, from about 0.5 weight percent to about 1 weight percent of a polymeric processing aid; and, from about 0.3 weight percent to about 0.5 weight percent of a material that acts as a stabilizer and anti-oxidant. The present invention is designed to have a long shelf life, high resistance to performance degradation after thermal aging testing and excellent physical properties such as excellent strength, insensitivity, and safety.

13 Claims, 1 Drawing Sheet

Figure 1:
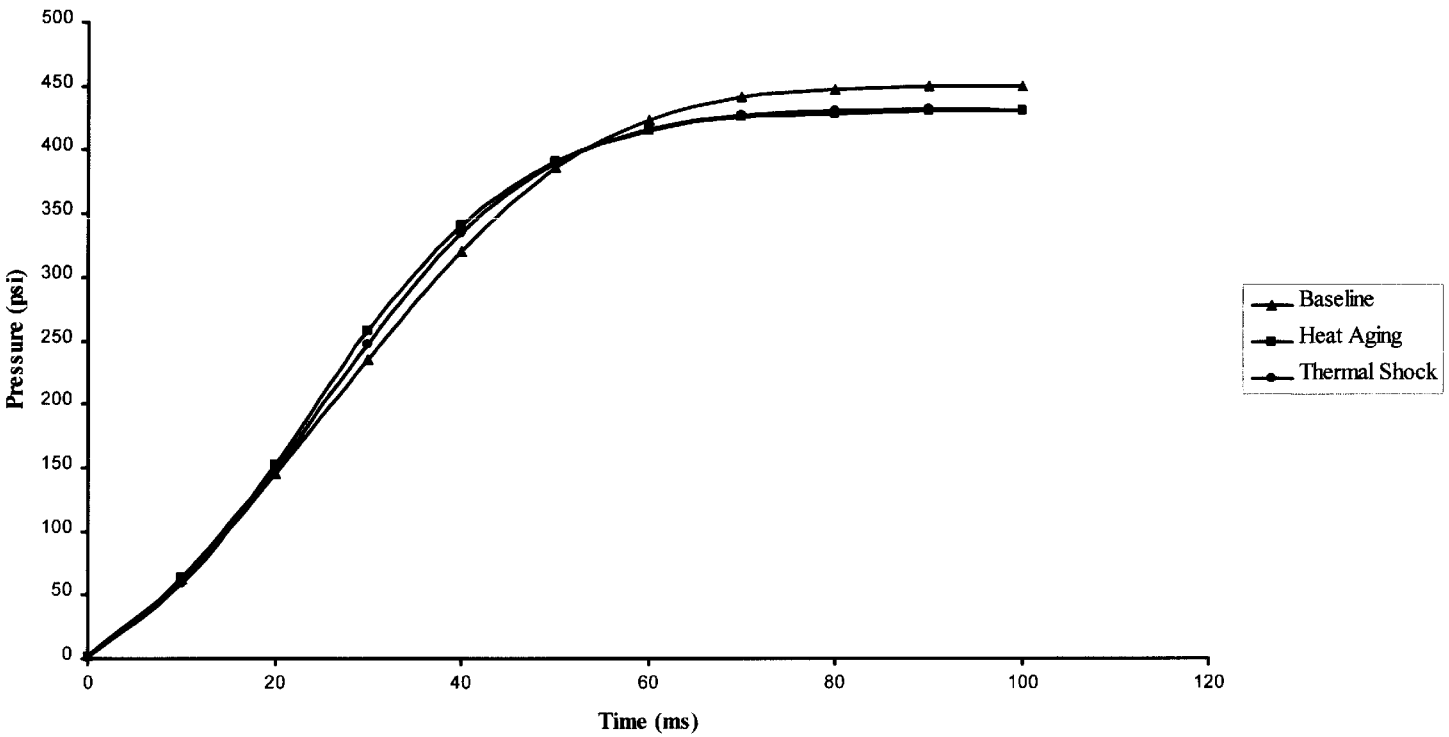

Heat Aging = 400 hours at 107°C  Thermal Shock = 30 min. at 107°C/30 min. at -40°C; 200 cycles (90 sec. Temp. change)

Heat Aging = 400 hours at 107°C Thermal Shock = 30 min. at 107°C/30 min. at -40°C; 200 cycles (90 sec. Temp. change)

AIRBAG PROPELLANT

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

The present invention pertains to the field of automobile inflatable safety systems and more particularly to propellants for hybrid inflator devices.

2. Brief Description of the Prior Art

Currently, gun-type propellants are used in hybrid inflators or airbag safety systems for vehicles and other personnel transportation devices. U.S. Pat. Nos. 5,602,361, 5,616,883, and 5,695,216 describe airbags devices that mix gases generated by gun type propellants with an inert gas and oxygen to inflate airbags under certain conditions. More particularly, carbon monoxide (CO) and hydrogen ($H_2$) in the propellant gases are converted by the oxygen to carbon dioxide ($CO_2$) and water. The burning of the gun type propellant and the oxidation of the $CO_2$ and $H_2$ provide heat, which drives the expansion of the compressed gases to inflate the airbag. This results in gases, which are non-toxic in nature, which is an important safety feature for airbag devices due to their use in close proximity to persons. Airbag propellants must also maintain their physical properties for use in vehicle systems where they will be subjected to harsh physical and thermal stresses.

However, the gun type propellants described in the U.S. patents above contain low molecular weight plasticizers, which over time, migrate within the propellants. This results in not only changes to the propellant composition, which changes the properties of the propellant, but also possible ballistic changes. These ballistic changes are caused by a decrease in the propellant surface area from the propellant grains sticking together due to a plasticizer-rich layer on the surface of the grains.

U.S. Pat. No. 6,009,810 describes an airbag propellant designed to alleviate this problem. The patent describes an airbag propellant that is plasticizer-free, while maintaining the good physical and mechanical characteristics necessary in commercial airbag systems. However, the propellant described in this patent also produces a pungent odor when used in the newer dual-stage hybrid inflators, which makes it problematic for such commercial uses.

Due to the limitations of the current technology described above, it would be desirable to provide an airbag propellant that maintained its properties, thereby increasing its shelf life, as well as produced no pungent odor. Such an airbag propellant would also need to produce nontoxic gases during operation and provide physical characteristics which make it suitable for vehicle systems subjected to harsh stresses.

SUMMARY OF THE INVENTION

Accordingly, it is an object of this invention to provide a new propellant for hybrid inflator systems for safety airbags.

It is a further object of this invention to provide a new airbag propellant having a long shelf life.

It is still a further object of this invention to provide a new airbag propellant that does not provide a significant decrease in performance after undergoing thermal shock and heat aging.

It is still a further object of this invention to provide a new airbag propellant having no pungent odor upon ignition.

This invention accomplishes these objectives and other needs related to airbag propellants by providing an airbag propellant composition comprising from about 70 weight percent to about 82 weight percent Cyclotrimethylenetrinitramine (RDX), from about 10 weight percent to about weight percent Cellulose Acetate Butyrate (CAB), from about 6 weight percent to about 9 weight percent Acetyl Triethyl Citrate (ATEC), from about 2 weight percent to about 4 weight percent Hydroxypropyl Cellulose (HPC), from about 0.5 weight percent to about 1 weight percent vVestenamer, and from about 0.3 weight percent to about 0.5 weight percent Ethyl Centralite (EC).

DESCRIPTION OF THE PREFERRED EMBODIMENT

The present invention is an airbag propellant composition designed to be used as a substitute for the current gun-type propellants used in hybrid inflators for airbag safety systems in vehicles. The present invention is designed to have a long shelf life, high resistance to performance degradation after thermal aging testing and excellent physical properties such as excellent strength, insensitivity, and safety. The present invention is also designed to be fully operative for use in hybrid inflators for airbag safety systems without emitting a pungent odor during use. The present invention achieves these goals by taking Cyclotrimethylenetrinitramine (RDX) and combining it with a polymer binder, an inert plasticizer, a stabilizing and anti-oxidizing material, and unique processing aids.

In describing the present invention, all percentages given below are percentages by weight. The airbag propellant of the present invention comprises from about 70 percent to about 82 percent RDX particles with from about 10 percent to about 15 percent of a polymer binder, and from about 6 percent to about 9 percent of an inert plasticizer. From about 0.3 percent to about 0.5 percent of a material that acts as a stabilizer and an anti-oxidant is used as well as from about 2 percent to about 4 percent of Hydroxypropyl Cellulose and from about 0.5 percent to about 1 percent of a polymeric processing aid.

The particle size of RDX is directly proportional to its burning rate. The RDX particles used in the present invention are small in nature in order to select the proper burning rate for the propellant and are selectable by one skilled in the art. A preferable range of sizes of the RDX particles comprises from about 2 microns to about 12 microns, with a particle size of about 7 microns being most preferable.

The use of from about 2 percent to about 4 percent of Hydroxypropyl Cellulose is important to the operation and physical properties of the invention. In the most preferable embodiment of the invention, about 3 percent Hydroxypropyl Cellulose is used. The Hydroxypropyl Cellulose, along with the polymeric processing aid described more fully below, are designed to replace the Nitrocellulose normally used in LOVA type propellants. Nitrocellulose was a critical element of those LOVA propellants as a binder and processing aid. However, when used as an airbag propellant, the Nitrocellulose causes the propellant to have very poor shelf life because of its tendency to decompose when exposed to the extreme heat requirements of airbag propellant thermal testing. When the Nitrocellulose breaks down, the properties of the propellant change. This has an adverse affect upon the operation of the propellant, and, due to the safety impact related to the above described use, it is unacceptable for such use. The Hydroxypropyl Cellulose and polymeric processing aid are designed to replace the Nitrocellulose in function and provide a propellant with excellent shelf life. FIG. 1 shows how the properties of the present invention remain nearly constant, even when exposed to dramatic heat and pressure changes over time. FIG. 1 shows three curves. The first, relates to the ballistic properties of the present invention initially. The second, relates to the present invention after subjecting it to 200 cycles of increasing temperature to 107 degrees C. and decreasing the temperature to −40 degrees C. for thirty minutes each. The third relates to the present invention after it was exposed to 107 degrees C. for 400 hours. As one can see, all three curves are nearly identical, showing the excellent performance of the present invention after being exposed to thermal stresss.

As noted above, from about 0.5 percent to about 1 percent of a polymeric processing aid is used in the present invention. The most preferred embodiment of the invention uses approximately 0.675 percent of a polymeric processing aid. Without a polymeric processing aid, the propellant is difficult to mix and extremely difficult to extrude. The polymeric processing aid also improves the strand integrity of the propellant, which makes it easier to handle during the cutting process. The most preferred polymeric processing aid for the present invention is Vestenamer 6213, which is a polyoctenamer with a medium trans content of around 60 percent. Vestenamer 6213 is normally used as a blend component in rubbers in order to improve plasticity in the mixing process and enhance filler incorporation and dispersion to lower energy consumption and dump temperature.

From about 10 percent to about 15 percent of a polymer binder is used in the present invention that should be compatible with the other constituents of the invention and may be selected by one skilled in the art. Examples of such polymer binders are Cellulose Acetate Butyrate (CAB), Cellulose Acetate (CA), Polyurethane, Hydroxy-terminated Polybutadiene, Ethyl Cellulose, Glycidyl Acid Polymers, polymers of 3-nitrateeomethyl-3-oxetane, or polymers of Glycidyl Nitrate Polyglyn with the most preferred polymer binder being CAB. The most preferred amount of polymer binder of the present invention is approximately 12.325 percent.

From about 6 percent to about 9 percent of an inert plasticizer is used in the present invention, with a more preferred amount being approximately 7.6 percent. Examples of such inert plasticizers include Acetyl Triethyl Citrate and Tributyl Citrate with the most preferred being Acetyl Triethyl Citrate.

Finally, from about 0.3 percent to about 0.5 percent of a material that acts as a stabilizer and an anti-oxidant is used, with a most preferred amount being approximately 0.4 percent. A most preferred material is Ethyl Centralite.

The description of a typical inflator mechanism for an inflatable automotive safety system, where the present invention is used as the propellant grains, can be found in U.S. Pat. No. 5,616,883, column 4, line 39 through column 7, line 27 and column 9, line 21 through column 10, line 32, along with FIGS. 1, 2, and 2A which are hereby incorporated by reference.

To summarize the operation of the system described in the above patent, a detector sends a signal to an initiator to propel a projectile that initially passes through a closure disk to open a passageway between the inflator housing and the airbag. The projectile continues movement until it impacts a piston that actuates a projecting rim to strike at least one primer. This results in the ignition/booster charge igniting, which, in turn, ignites the propellant grains. During combustion of the propellant grains, a pressurized medium from the inflator housing, normally comprised of an inert gas and a predetermined amount of oxygen, is drawn into a gas generator housing through an inlet nozzle positioned at the end of the housing. This results in the flow of the pressurized medium by a sidewall of the gas generator housing, producing a pressure differential. This results in mixing of the propellant gases and the pressurized medium. Gases are then discharged from the gas generator housing through discharge nozzles on the sidewall of the housing, augmenting the flow to the airbag.

The experimental example illustrates a method for preparing the airbag propellant of the present invention. In general, the RDX is wetted by mixing with Ethyl Alcohol and is combined with CAB and Hydroxypropyl Cellulose and mixed. Ethyl Centralite, after being dissolved in Ethyl Acetate, is then added and mixing continues. Vestenamer and Acetyl Triethyl Citrate, after being mixed with Ethyl Acetate, is added and the mixing is concluded. Ethyl Alcohol and Ethyl Acetate are sufficiently removed to obtain a proper consistency for extruding. The mixture is extruded, solvent-wet, into strands, which are then cut into appropriately sized grains. The grains are then dried to remove the remaining Ethyl Alcohol and Ethyl Acetate. These grains are then used in the vehicle airbag safety system described above.

The general nature of the invention having been set forth, the following example is presented as a specific illustration thereof. It will be understood that the invention is not limited to this specific example, but can be practiced with various modifications that will be recognized by one of ordinary skill in the art.

EXPERIMENTAL EXAMPLE

First, add 76.00 pounds of RDX and 7.20 pounds of Ethyl Alcohol to a 25 gallon, horizontal, sigma blade mixer. Mix this combination in a reverse direction for 10 minutes at ambient temperature (70–80 degrees F.). Then add 12.33 pounds of Cellulose Acetate Butyrate and 3.00 pounds of Hydroxypropyl Cellulose to the mixer and mix the combination in a forward direction for 15 minutes at 90 degrees F. Next, take 0.40 pounds of Ethyl Centralite and dissolve it in 11.40 pounds of Ethyl Acetate. Add this mixture to the mixer and mix in a reverse direction for 1 minute to incorporate the solvent into the combination, then mix the combination in a forward direction for twenty minutes at 100 degrees F. Next, take 7.60 pounds of Acetyl Triethyl Citrate and mix it with 11.400 pounds of Ethyl Acetate. Add this mixture to the mixer and mix in a reverse direction for 1 minute to incorporate the solvent into the combination, then mix the combination in a forward direction for seventy minutes at 120 degrees F. Then, lower the temperature to 80 degrees F., open the mixer lid, and blow air at 40 psi onto the combination while the blades of the mixer are turned in forward until enough of the Ethyl Alcohol and Ethyl Acetate are removed to get the combination to a consistency that is proper for extrusion. Next, lower the temperature to 50 to 70 degrees F., turn off the air, close the mixer lid, and turn the blades in a reverse direction until the combination temperature reaches 75 degrees F. The propellant is then removed from the mixer, extruded through appropriate dies and pin plates, and granulated to desired sizes. The propellant is finally dried in an oven until the Ethyl Acetate and Ethyl Alcohol are substantially removed.

The airbag propellant of the present invention performs extremely well in aging and thermal testing. It also produces no toxic gases because all of the ingredients are made up of carbon, hydrogen, nitrogen, and oxygen resulting in major combustion products of carbon dioxide and water. The ingredients are also relatively inexpensive, particularly compared to current airbag propellant ingredients. Finally, upon ignition, no pungent odors emanate from the propellant.

What is described are specific examples of many possible variations on the same invention and are not intended in a limiting sense. The claimed invention can be practiced using other variations not specifically described above.

What is claimed is:

1. An improved inflator for an automotive inflatable safety system, comprising:

a pressurized medium contained within the inflator housing, the pressurized medium consisting essentially of a predetermined amount of an inert gas and a predetermined amount of oxygen, a gas generator assembly interconnected with the inflator housing and comprising a gas generator housing and at least one gas generator outlet, a propellant contained within the gas generator housing, and, an inflator activation assembly, wherein the pressurized medium is released from the inflator housing and the propellant is ignited to produce the propellant gases, the improvement, comprising wherein the propellant, comprises:

from about 70 weight percent to about 82 weight percent Cyclotrimethylenetrinitramine (RDX), from about 10 weight percent to about 15 weight percent of a polymer binder, from about 6 weight percent to about 9 weight percent of an inert plasticizer, from about 2 weight percent to about 4 weight percent of Hydroxypropyl Cellulose, and, from about 0.5 weight percent to about 1 weight percent of a polymeric processing aid.

2. The inflator of claim 1, further comprising from about 0.3 weight percent to about 0.5 weight percent of a material that acts as a stabilizer and anti-oxidant comprising Ethyl Centralite.

3. The inflator of claim 2, wherein the polymer binder comprises Cellulose Acetate Butyrate.

4. The inflator of claim 3, wherein the inert plasticizer comprises a material selected from Acetyl Triethyl Citrate or Tributyl Citrate.

5. The inflator of claim 4, wherein the inert plasticizer comprises Acetyl Triethyl Citrate.

6. The inflator of claim 5, wherein the propellant comprises approximately 76 weight percent RDX.

7. The inflator of claim 6, wherein the propellant comprises approximately 3 weight percent Hydroxypropyl Cellulose.

8. The inflator of claim 7, wherein the propellant comprises approximately 0.675 weight percent Vestenamer 6213.

9. The inflator of claim 8, wherein the propellant comprises approximately 12.325 weight percent Cellulose Acetate Butyrate.

10. The inflator of claim 9, wherein the propellant comprises approximately 7.6 weight percent Acetyl Triethyl Citrate.

11. The inflator of claim 10, wherein the propellant comprises approximately 0.4 weight percent Ethyl Centralite.

12. A propellant composition, comprising:

from about 70 weight percent to about 82 weight percent Cyclotrimethylenetrinitramine (RDX), from about 10 weight percent to about 15 weight percent of a polymer binder, from about 6 weight percent to about 9 weight percent of an inert plasticizer, from about 2 weight percent to about 4 weight percent of Hydroxypropyl Cellulose, from about 0.5 weight percent to about 1 weight percent of a polymeric processing aid; and, from about 0.3 weight percent to about 0.5 weight percent of a material that acts as a stabilizer and anti-oxidant.

13. The propellant composition of claim 12, comprising:

approximately 76 weight percent RDX, approximately 12.325 weight percent Cellulose Acetate Butyrate, approximately 3 weight percent Hydroxypropyl Cellulose, approximately 7.6 weight percent Acetyl Triethyl Citrate, approximately 0.675 weight percent of the polymeric processing aid; and, approximately 0.4 weight percent Ethyl Centralite.

* * * * *